US007707980B2

(12) United States Patent
Arima

(10) Patent No.: US 7,707,980 B2
(45) Date of Patent: May 4, 2010

(54) VARIABLE VALVE ACTUATION MECHANISM FOR AN INTERNAL COMBUSTION ENGINE

(75) Inventor: Kazuki Arima, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 236 days.

(21) Appl. No.: 11/901,188

(22) Filed: Sep. 14, 2007

(65) Prior Publication Data

US 2008/0066702 A1 Mar. 20, 2008

(30) Foreign Application Priority Data

Sep. 19, 2006 (JP) ..... 2006-252322

(51) Int. Cl.
*F01L 1/34* (2006.01)

(52) U.S. Cl. ..... 123/90.16; 123/90.15; 123/90.17

(58) Field of Classification Search ..... 123/90.15, 123/90.16, 90.17
See application file for complete search history.

(56) References Cited

U.S. PATENT DOCUMENTS

| | | | | |
|---|---|---|---|---|
| 4,199,202 | A | 4/1980 | Maeda | |
| 6,019,076 | A * | 2/2000 | Pierik et al. | 123/90.16 |
| 7,032,551 | B2 * | 4/2006 | Eguchi et al. | 123/90.16 |
| 2005/0193968 | A1 | 9/2005 | Nohara et al. | |

FOREIGN PATENT DOCUMENTS

| | | | |
|---|---|---|---|
| EP | 1335114 | A1 | 8/2003 |
| EP | 1574679 | A2 | 9/2005 |
| JP | 2005-226543 | | 8/2005 |
| WO | WO-03/069134 | A1 | 8/2003 |
| WO | WO 03069134 | A1 * | 8/2003 |

OTHER PUBLICATIONS

English Abstract for JP-2005-226543.

* cited by examiner

*Primary Examiner*—Zelalem Eshete
(74) *Attorney, Agent, or Firm*—Global IP Counselors, LLP

(57) ABSTRACT

A variable valve actuation mechanism for an internal combustion engine includes a drive shaft that rotates in operative association with rotation of a crankshaft, thereby to drive an intake or exhaust valve to open or close by way of a rocker arm; and a control shaft that is rotated by driving of a control shaft actuator and that causes variation of the position of the rocker arm, thereby to cause a lift characteristic of the intake or exhaust valve to be continuously variable. The control shaft includes a flange portion protruding from an outer circumferential surface of the control shaft to thereby regulate movement in an axial direction of the control shaft. A cylinder head rotatably supporting the control shaft includes a flange bearing portion that contacts the flange portion. The flange portion includes a stopper protrusion that protrudes from the flange portion and that contacts the flange bearing portion, thereby to regulate a rotation range of the control shaft.

6 Claims, 5 Drawing Sheets

VARIABLE VALVE ACTUATION MECHANISM FOR AN INTERNAL COMBUSTION ENGINE

CROSS-REFERENCES TO RELATED APPLICATION

This application claims priority from Japanese Patent Application Serial 2006-252322 filed Sep. 19, 2006, the entire contents of which are incorporated herein by reference.

TECHNICAL FIELD

The disclosed apparatus relates to a variable valve actuation mechanism for an internal combustion engine.

BACKGROUND

Generally, variable valve actuation mechanisms open and close an intake or exhaust valve in mechanically operative association with the rotation of a crankshaft of an internal combustion engine and vary the lift characteristic of the intake or exhaust valve in conjunction with the rotation of a control shaft. The variable valve actuation mechanism positions the control shaft with respect to the direction of the cylinder array of the internal combustion engine. Therefore, the mechanism includes an axial direction positioning mechanism configured to maintain the position the control shaft with respect to the cylinder array of the internal combustion engine.

Japanese Patent Application Laid-Open (JP-A No. 2005-226543) discloses a variable valve actuation mechanism. The mechanism includes a stopper mechanism configured to mechanically regulate a rotational range of the control shaft. However, a control target value for electronically controlling the control shaft is set to a range smaller than the mechanical-rotational range provided by the stopper mechanism. The stopper mechanism of JP-A-2005-226543 includes two stoppers and stopper pins configured to abut thereagainst. The two stoppers, respectively, extend along the axial direction of the control shaft, i.e., extending to the side of control shaft, from an actuator plate fixed to the cylinder head, and the stopper pins extend along the radial direction of the control shaft. The two stoppers are spaced apart from each other with a predetermined distance therebetween.

Accordingly the configuration disclosed in JP-A-2005-226543 requires the stopper mechanism and axial direction positioning mechanism to be provided independently from one another. For this reason, a large layout space is necessary, which leads to an increase in the size of the variable valve actuation mechanism.

SUMMARY

In view of the above-described problem, a variable valve actuation mechanism for an internal combustion engine includes: a drive shaft which rotates in operative association with the rotation of a crankshaft, thereby to drive an intake or exhaust valve to open or close by way of a rocker arm; and a control shaft which is rotated by the driving of a control shaft actuator and which causes variation of the position of the rocker arm, thereby to cause a lift characteristic of the intake or exhaust valve to be continuously variable. The control shaft includes a flange portion protruding from an outer circumferential surface thereof configured to regulate movement in an axial direction of the control shaft. A cylinder head rotatably supporting the control shaft includes a flange bearing portion that contacts the flange portion. The flange portion includes a stopper protrusion protruding from the flange portion that contacts the flange bearing portion, thereby regulating a rotational range of the control shaft.

The flange portion, which regulates the movement of the control shaft along the axial direction of the control shaft, includes the stopper protrusion which regulates the rotational range of the control shaft. Consequently, the compactness of the overall variable valve actuation mechanism may be improved.

BRIEF DESCRIPTION OF THE DRAWINGS

While the claims are not limited to the illustrated embodiments, an appreciation of various aspects of the system is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

DETAILED DESCRIPTION

One exemplary embodiment will be described hereinbelow with reference to the accompanying drawings.

Figure 1:
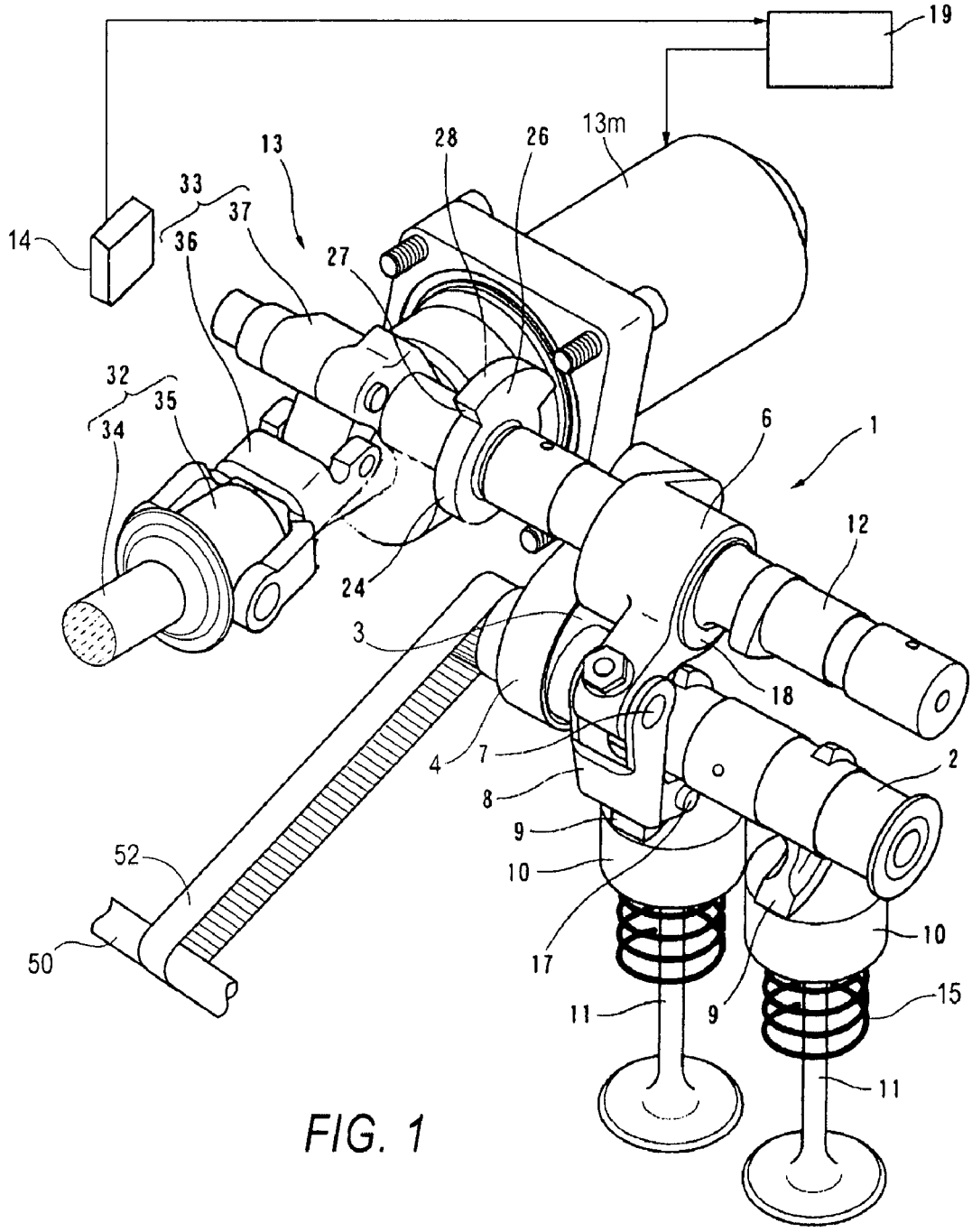
FIG. 1 is a perspective view showing a general configuration of a variable valve actuation mechanism for an internal combustion engine (or simply "variable valve actuation mechanism, hereinbelow) of one exemplary embodiment.
Figure 2:
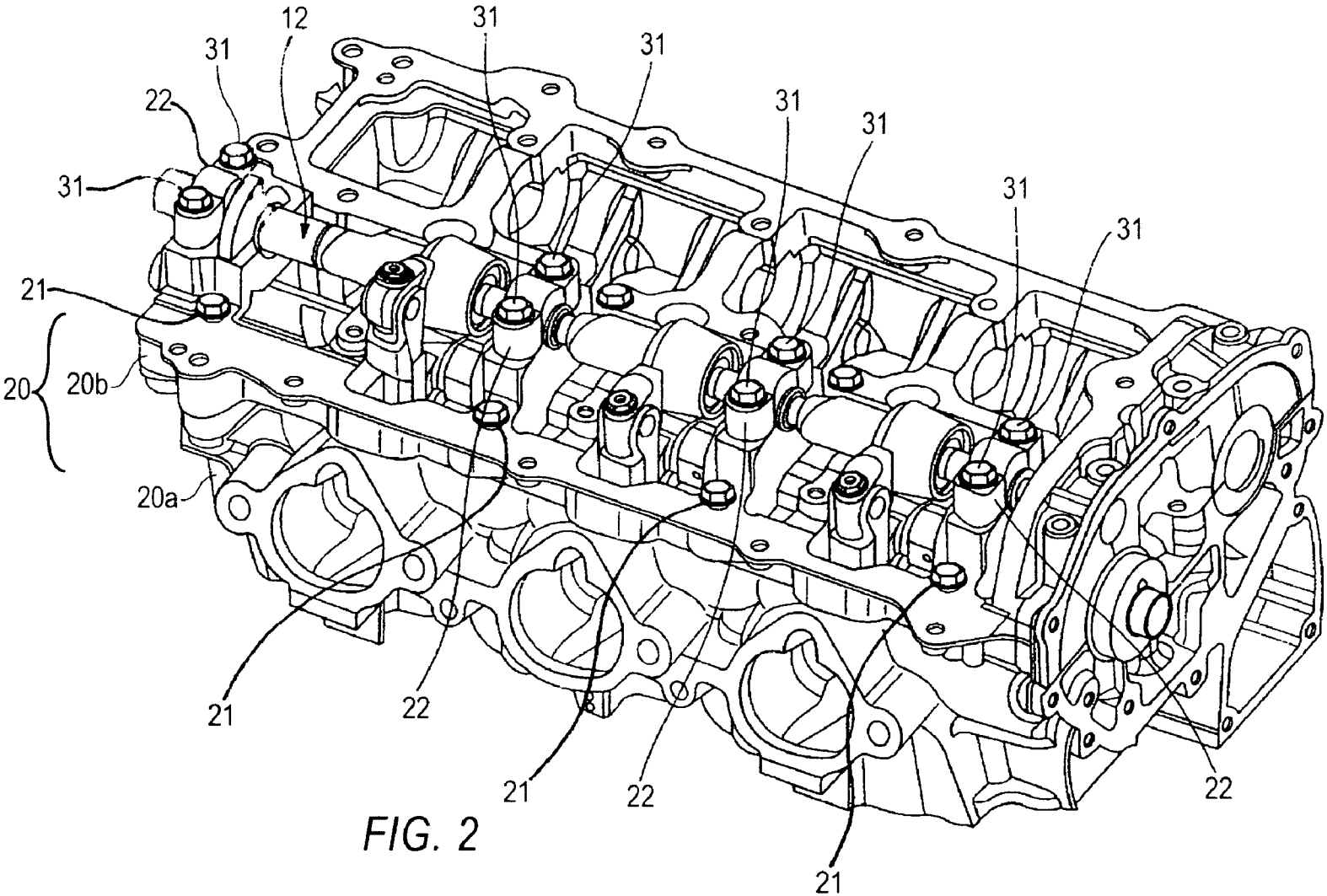
FIG. 2 is a perspective view showing a general configuration of the variable valve actuation mechanism of the exemplary embodiment supported above a cylinder head.
Figure 3:
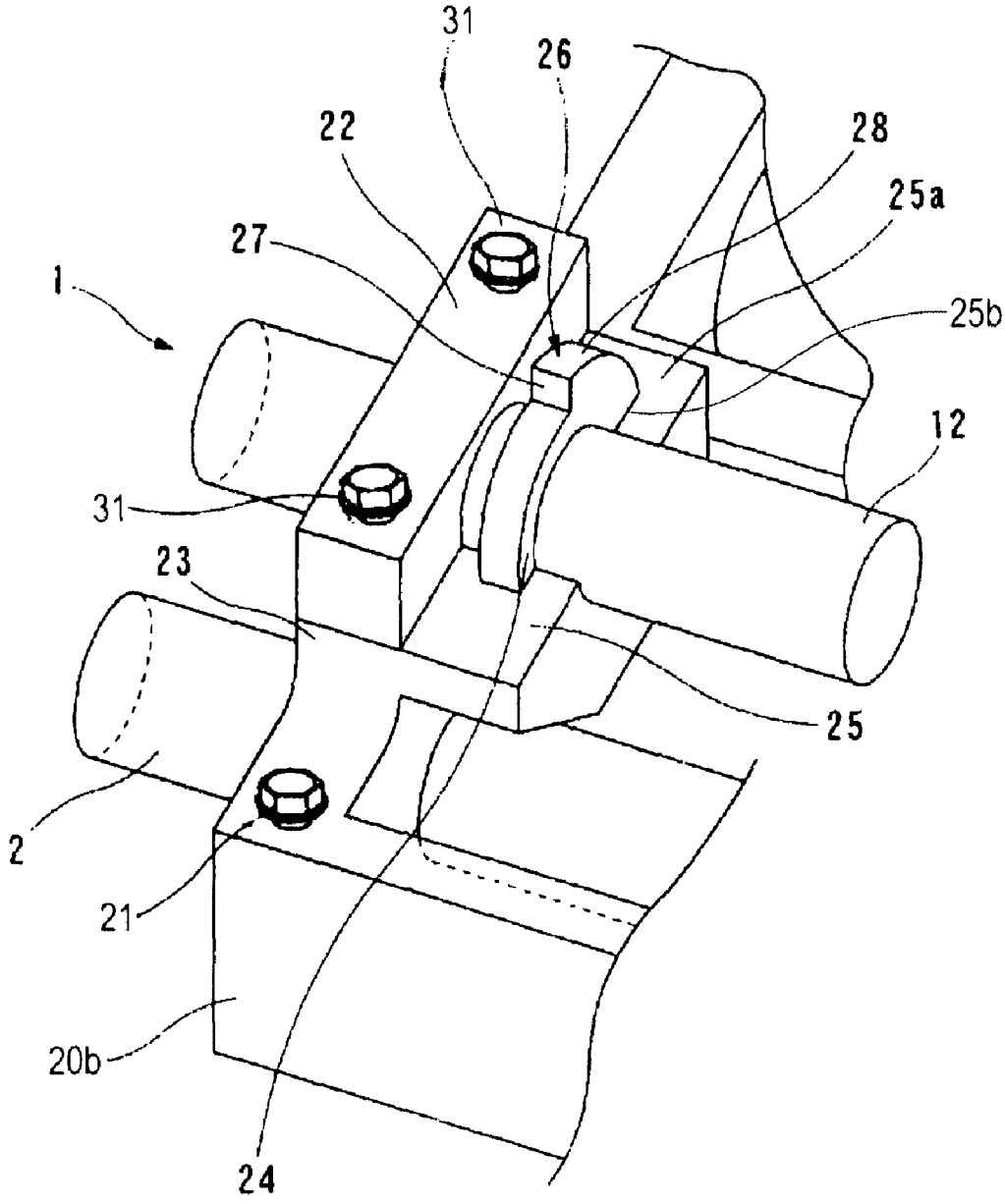
FIG. 3 is a perspective view showing a portion of the variable valve actuation mechanism according to the exemplary embodiment supported above a cylinder head.
Figure 4:
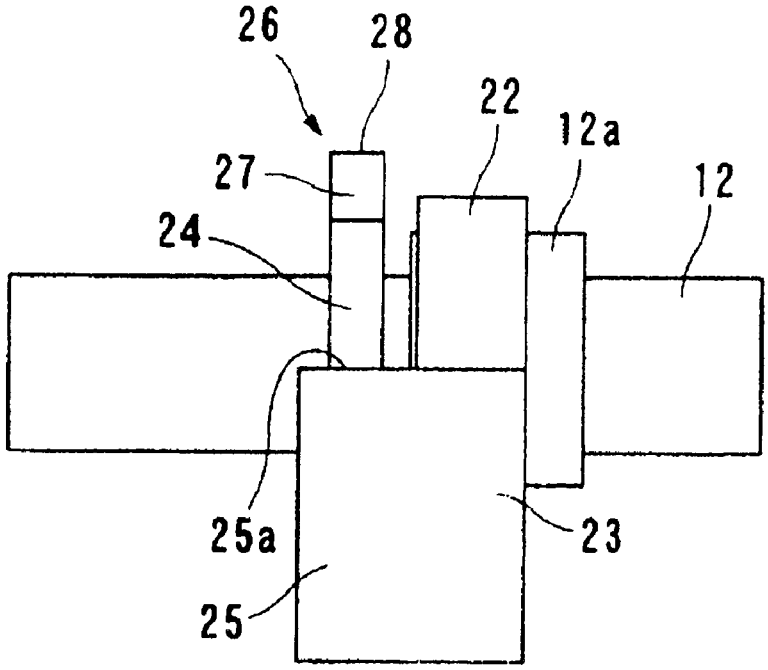
FIG. 4 is a side view of a major portion of the variable valve actuation mechanism of the exemplary embodiment.
Figure 5:
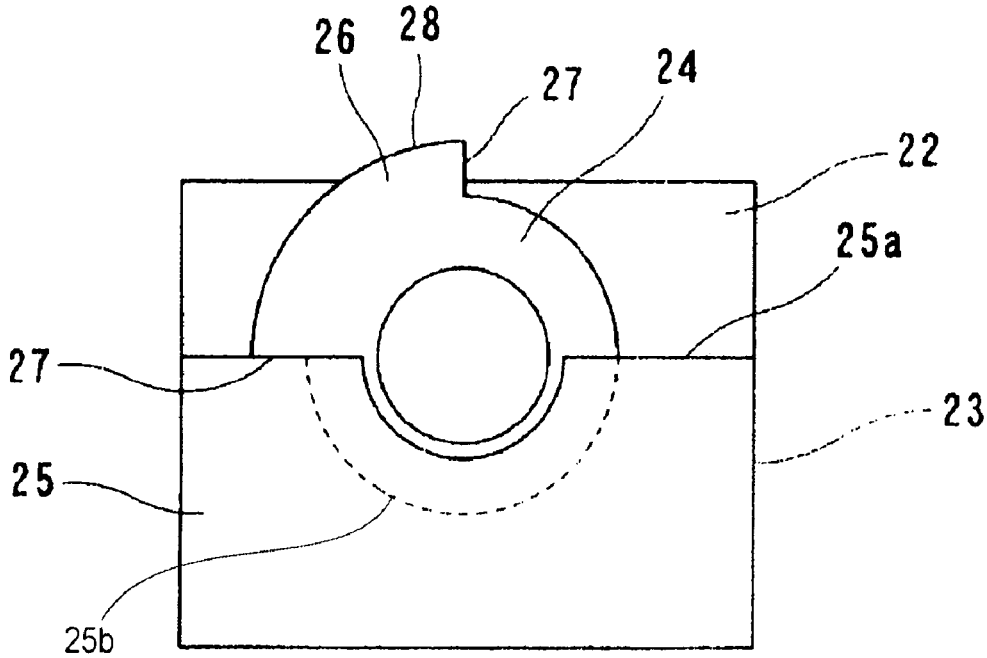
FIG. 5 is a front view of a major portion of the variable valve actuation mechanism of the exemplary embodiment.
Figure 6:
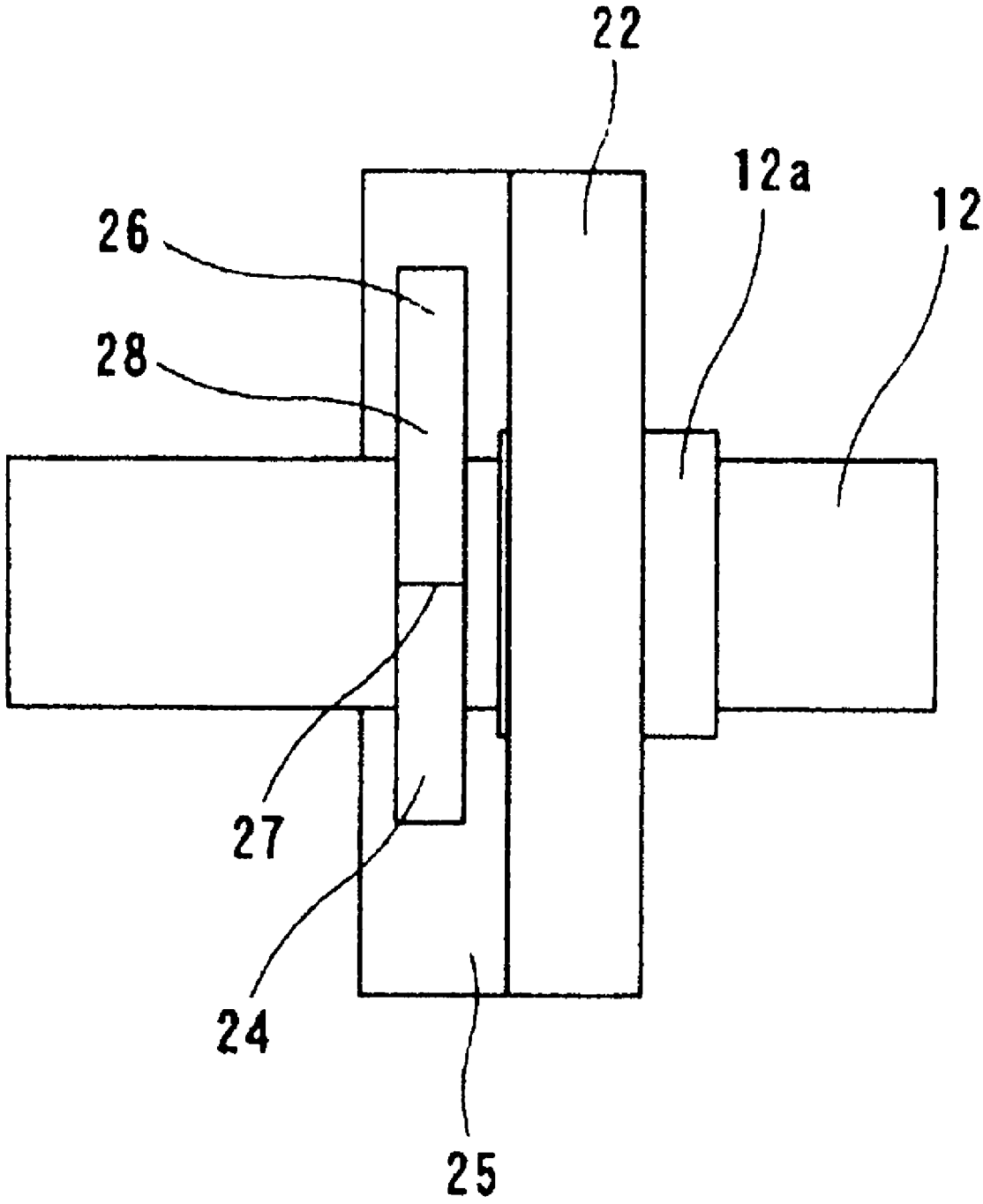
FIG. 6 is a top view of the major portion of the variable valve actuation mechanism of the exemplary embodiment.

FIG. 1 is a perspective view showing a variable valve actuation mechanism 1 in an abbreviated fashion. The variable valve actuation mechanism 1 represents a lift operating angle variable mechanism. The mechanism operates to open and close a respective intake valve 11 in mechanically operative association with rotation of a crankshaft 50. Other engine components generally associated with a timing belt 52 and the crankshaft 50 are omitted for brevity. Further, the mechanism continually varies lift characteristics of the respective intake valve 11 including both a valve lift amount and an operating angle thereof. Since the variable valve actuation mechanism 1 is a technique already known by, for example, JP-A-2005-226543 referenced above, only outline descriptions will be made hereinbelow.

The variable valve actuation mechanism 1 includes a drive shaft 2, a drive eccentric shaft portion 3, a control shaft 12, a control eccentric shaft portion 18, a rocker arm 6, and a pivotal cam 9. The drive shaft 2 is rotatably journaled by a cylinder head 20 and a head lower portion 20*a* (described further below) below the cylinder head 20 and extends along the cylinder array direction over the intake valve 11. The drive eccentric shaft portion 3 is fixedly attached by a press fitting or the like to the drive shaft 2 in order to be integrally rotatable therewith. The control shaft 12 is rotatably supported by a ladder cam bracket 20*b* (described further below) above the cylinder head 20 in an upper position of the drive shaft 2, and located parallel to the drive shaft 2. The control eccentric shaft portion 18 is fixedly attached by a press fitting or the like to the control shaft 12 thereby being integrally rotatable therewith. The rocker arm 6 is an intermediate member rotatably supported by the control eccentric shaft portion 18. The pivotal cam (valve actuation cam) 9 is pivotally fitted to the drive shaft 2. The drive eccentric shaft portion 3 and one end of the rocker arm 6 are linked together by an arm-shaped first link 4, and the other end of the rocker arm 6 and the pivotal cam 9 are linked together by a second link 8 having an annular end.

The drive shaft 2 is driven by the engine crankshaft 50 via a timing chain or timing belt 52, and rotates about the axis in mechanically operative association with rotation of the crankshaft 50. The drive eccentric shaft portion 3 has a circular outer circumferential surface, in which the center of the circular outer circumferential surface is offset by a predetermined amount from the axial center of the drive shaft 2. The rocker arm 6 is arranged such that a substantially central portion is pivotally supported by the control eccentric shaft portion 18. One end of the rocker arm 6 is coupled to the first link 4 via a coupling pin (not shown), and the other end is coupled to the second link 8 via a coupling pin 7. The control eccentric shaft portion 18 is axially offset by a predetermined amount from the control shaft 12. Accordingly, the pivotal center of the rocker arm 6 varies according to the rotation angle position (or, simply "angle position") of the control shaft 12.

A front end of the pivotal cam 9 and the second link 8 are coupled together via a coupling pin 17. A lower surface of the pivotal cam 9 includes an arcuate base concentric with the drive shaft 2 and a cam surface extending from the arcuate base, thereby forming a predetermined curve. The arcuate base and cam surface are selectively brought into contact with an upper surface of a tappet (or, valve lifter) 10 based on the pivotal position of the pivotal cam 9. More specifically, the arcuate base works as a base circle section where the amount of lift is set to zero. When the pivotal cam 9 pivots and contacts the tappet 10, the intake valve 11 is depressed in opposition to the reaction forces of a valve spring 15, whereby the intake valve 11 is progressively lifted.

With reference to FIG. 1, the control shaft 12 is rotated within a predetermined rotation angle range by a control shaft actuator 13 mechanically coupled to one end of the control shaft 12. The control shaft actuator 13 includes an electric motor 13*m* serving as a drive source, a ball screw mechanism 32 coupled to the electric motor 13*m*, and a link mechanism 33 for linking the ball screw mechanism 32 to the control shaft 12. Accordingly, the control shaft actuator 13 transfers the rotational force of the electric motor 13*m* to the control shaft 12 via the ball screw mechanism 32 and the link mechanism 33.

The ball screw mechanism 32 includes a ball screw 34, e.g. a slender columnar ball screw, and a ball nut 35. The ball screw 34 is rotated by the electric motor 13*m* and has an externally threaded portion on an outer circumferential surface. The ball nut 35 engages the ball screw 34, thereby to advance/retract or reciprocate along the axial direction of the ball screw 34 without being rotated by the rotation of the ball screw 34. The link mechanism 33 includes first and second pivotal links 36 and 37. The first pivotal link 36 is operatively associated with the ball nut 35. The second pivotal link 37 has a substantially L-shaped opposing end fixed to the control shaft 12, which thereby converts the advancing/retracting motion (linear motion) of the ball nut 35 to the rotation or rotational motion that rotates the control shaft 12.

A control shaft sensor 14, such as a potentiometer, detects the rotation angle positions of the control shaft 12 and the control eccentric shaft portion 18 thereof. In accordance with a detection signal of the control shaft sensor 14, a control device (control means) 19 outputs a corresponding control signal to the control shaft actuator 13, thereby to provide closed loop control of the rotation angle position of the control shaft 12 to a desired or target value.

Operation of the variable valve actuation mechanism 1 will be briefly described hereinbelow.

Upon rotation of the drive shaft 2, the pivotal cam 9 starts pivoting by way of the drive eccentric shaft portion 3, the first link 4, the rocker arm 6, and the second link 8. The pivotal cam 9 thus pivoted depresses the tappet 10, thereby to cause alternate opening and closing of the intake valve 11 under the spring forces of the valve spring 15.

Further, when the angle position of the control shaft 12 is altered by control shaft actuator 13, the initial position of rocker arm 6 is altered, whereby the valve lift characteristic associated with the operation of the pivotal cam 9 is continuously varied. More specifically, the lift and the operating angle can be both increased and decreased continuously and synchronously. For example, although dependent upon the layouts of respective portions, the opening and closing timings of the intake valve 11 are varied substantially symmetrically in association with variations in the amounts of the lift and operating angle.

The engine configuration includes a plurality of cylinders constituting a cylinder array. The drive shaft 2 and the control shaft 12 extend along the cylinder array, and are used commonly by the plurality of cylinders. However, the pivotal cam 9, the rocker arm 6, the first link 4, the second link 8, and the like components are provided in units of the respective cylinder constituting the cylinder array of the variable valve actuation mechanism 1 (lift operating angle variable mechanism).

As shown in FIGS. 2 to 6, the variable valve actuation mechanism 1 is supported by being fixed atop the cylinder head 20 of the internal combustion engine.

The cylinder head 20 is configured in the manner that a ladder cam bracket 20*b* having a so-called ladder frame structure, in which a plurality of bearing caps 22 (or, "cap portions") are integrally formed with a frame, is detachably mounted on the upper surface of the head lower portion 20*a* functioning as a head body. The ladder cam bracket 20*b*, functioning as a head upper portion, is fastened to the head lower portion 20*a* by a plurality of head-upper portion attaching bolts 21.

The drive shaft 2 and the control shaft 12, respectively, extend along the cylinder array in a parallel arrangement to each other. The drive shaft 2 is rotatably supported in such a manner as to be clamped by the head lower portion 20*a* and the ladder cam bracket 20*b* at a plurality of portions along the axial direction. The control shaft 12 is placed on the upper surface of the ladder cam bracket 20*b*, and is supported rotatably by the ladder cam bracket 20*b* and the bearing caps 22 at a plurality of portions along the axial direction, in which the bearing caps 22 are each fixed by means of cap fastening bolts 31. In other words, the control shaft 12 is rotatably supported in the manner that respective journal portions 12*a* thereof are rotatably supported by control shaft bearing portions 23 of the ladder cam bracket 20*b* and the bearing caps 22 (as the cap portions). The control shaft bearing portions 23, respectively, refer to bearing body portions that rotatably support the control shaft 12.

The bearing cap 22 is arranged in such a manner as to straddle the control shaft 12. More specifically, the bearing cap 22 is fixed to the ladder cam bracket 20*b* by using two cap fastening bolts 31 thereby bracing the control shaft 12 in the direction perpendicular to the axial direction of the control shaft 12.

The control shaft 12 has a ring-like flange portion 24 in a position adjacent to the journal portions 12*a* on the end of the control shaft 12 that is operatively coupled to the control shaft actuator 13. The flange portion 24 extends from the outer circumferential surface of the control shaft 12, and regulates the movement of the control shaft 12 along the axial direction. The flange portion 24 has a predetermined thickness in the axial direction of the control shaft 12, and is rotatably supported by a flange bearing portion 25 projecting from the control shaft bearing portion 23 supporting the adjacent journal portions 12*a*. The flange portion 24 engages a groove 25*b* formed in an upper surface of the flange bearing portion 25. The flange 24 abuts sidewall surfaces of the groove 25*b*, thereby regulating the axial position of the control shaft 12. The flange bearing portion 25 is substantially integral with the control shaft bearing portion 23.

The flange portion 24 has, on its outer perimeter, a stopper protrusion 26 projecting outwardly in the radial direction of the control shaft 12. The stopper protrusion 26 is substantially circularly arcuate, and regulates a rotation range of the control shaft 12. The stopper protrusion 26 has the same thickness in the axial direction of the control shaft 12 as the thickness of the flange portion 24 in the axial direction of the control shaft 12. The rotation of the control shaft 12 brings the stopper protrusion 26 into surface contact with a stopper protrusion receiving surface 25*a* coincident with the upper surface of the flange bearing portion 25. More specifically, the stopper protrusion 26 includes a pair of erect walls 27 extending in the radial direction of the control shaft 12 and an outer circumferential wall 28 extending between the pair of erect walls 27. The erect walls 27 are perpendicular to the outer circumferential surface of the flange portion 24, and are configured to abut the stopper protrusion receiving surface 25*a* in conjunction with the rotation of the control shaft 12. The outer circumferential wall 28 is circularly arcuate and concentric with the flange portion 24.

The stopper protrusion receiving surface 25*a* is formed continuously with the coupled surfaces of the control shaft bearing portion 23 and the bearing cap 22. More specifically, the stopper protrusion receiving surface 25*a* is coincident with a plane extending along the axial center of the control shaft 12 in an installed configuration on the upper surface of the ladder cam bracket 20*b*. In other words, in the configuration, the stopper protrusion receiving surface 25*a* and the coupled surfaces of the control shaft bearing portion 23 and the bearing cap 22 are positioned on the same plane.

The erect walls 27 of the stopper protrusion 26 cooperate with the stopper protrusion receiving surface 25*a* to regulate the mechanical-rotational range of the control shaft 12. As described above, however, in order to precisely drive the control shaft 12 using a closed loop control, a control-rotational range defined by practical control target values for the control shaft 12, is set smaller than the mechanical-rotational range described above.

More specifically, a minimum value of the control target value is set such that a small margin exists before reaching a minimum limit position of the mechanical-rotational range defined by the abutting engagement of one erect wall 27 of the stopper protrusion 26 with the stopper protrusion receiving surface 25*a*. Likewise, a maximum value of the control target value is set such that a small margin exists before reaching a maximum limit position of the mechanical-rotational range defined by the abutting engagement of the other erect wall 27 of the stopper protrusion 26 with the stopper protrusion receiving surface 25*a*.

In the thus-configured variable valve actuation mechanism 1 for the internal combustion engine, the stopper protrusion 26 for regulating the mechanical-rotational range for the control shaft 12 is integrally formed with the flange portion 24 provided to regulate the movement along the axial direction of the control shaft 12. Integrally forming the stopper protrusion 26 with the flange portion 24 simplifies the regulation of the mechanical-rotational range of the control shaft 12 and reduces the overall size of the variable valve actuation mechanism 1. Additionally, such a configuration simplifies the assembly of the variable valve actuation mechanism 1.

In the configuration, the stopper protrusion 26 and the stopper protrusion receiving surface 25*a* may come into surface contact with one another. When the stopper protrusion 26 abuts the stopper protrusion receiving surface 25*a*, the maximum limit position in the mechanical-rotational range can be steadily maintained. Consequently, any adjustment of the valve lift amount that is to be carried out in the above-described state can be easily and accurately effectuated. Additionally, variations in the inter-cylinder valve lift amount can be further reduced.

The stopper protrusion receiving surface 25*a*, the coupled surfaces of the control shaft bearing portion 23, and the bearing cap 22 are all positioned on the same plane. As such, these elements may be machined at the same time, which may improve the production productivity.

Furthermore, the flange portion 24 formed with the stopper protrusion 26 is provided on the end of the control shaft 12 that is operatively coupled to the control shaft actuator 13 (the link mechanism 33). This reduces torsional stress on the portion of the control shaft 12 between the link mechanism 33 and the flange portion 24, thereby enabling a preventative offset of the minimum (or maximum) limit position of the control shaft 12 in the axial direction of the control shaft 12. Further, during assembly of the variable valve actuation mechanism 1, the rocker arm 6 can be inserted into the control shaft 12 from one direction, thereby improving the process of assembling the variable valve actuation mechanism 1.

Technical concepts and/or features of the present invention attainable from the embodiment and effects thereof are described below in a summary form.

(1) A variable valve actuation mechanism for an internal combustion engine includes a drive shaft which rotates in conjunction with rotation of the crankshaft and which drives an intake or exhaust valve to open or close by way of a rocker arm; and a control shaft which is rotated by driving of the control shaft actuator and which causes variation of the position of the rocker arm, thereby to cause a lift characteristic of the intake or exhaust valve to be continuously variable. The control shaft includes a flange portion which protrudes from an outer circumferential surface of the control shaft and which regulates movement of the control shaft along an axial direction of the control shaft. A cylinder head rotatably supporting the control shaft includes a flange bearing portion which contacts the flange portion. The flange portion includes a stopper protrusion which protrudes from the flange portion and which contacts the flange bearing portion, thereby to regulate the mechanical-rotational range of the control shaft. Since the flange portion, which regulates the movement of the control shaft along the axial direction of the control shaft, includes the stopper protrusion which regulates the rotation range of the control shaft, the overall size of the variable valve actuation mechanism may be reduced.

(2) In the variable valve actuation mechanism for an internal combustion engine, as described in (1), the stopper protrusion surface contacts a stopper protrusion receiving surface of the flange bearing portion, in which the stopper protrusion abuttingly engages the stopper protrusion receiving surface in conjunction with the rotation of the control shaft. When the stopper protrusion abuttingly engages the stopper protrusion receiving surface, a maximum limit position or a minimum limit position in the mechanical-rotational range of the control shaft can be steadily maintained. Consequently, adjustment of the valve lift amount to be carried out in the above-described state can be easily and accurately effectuated, and variation in the inter-cylinder valve lift amount can be further reduced.

(3) In the variable valve actuation mechanism for an internal combustion engine, as described in (2), the control shaft bearing includes a bearing body portion provided in a body of the internal combustion engine and a cap portion rotatably clamping a journal portion with the bearing body portion. In the configuration, the stopper protrusion receiving surface of the flange bearing portion and coupled surfaces of the bearing body portion and the cap portion are positioned on the same plane. With this configuration, the stopper protrusion receiving surface and the coupled surfaces of the control shaft bearing and the cap portion can be machined at the same time, so that productivity can be relatively improved.

(4) More specifically, in the variable valve actuation mechanism for an internal combustion engine, as described in (3), the bearing body portion and the flange bearing portion are integrally formed. Thereby, the configuration of the variable valve actuation mechanism can be simplified.

The preceding description has been presented only to illustrate and describe exemplary embodiments of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A variable valve actuation mechanism for an internal combustion engine, the mechanism comprising:

a drive shaft which rotates in operative association with rotation of a crankshaft, thereby to drive an intake or exhaust valve to open or close by way of a rocker arm;

a control shaft which is rotated by driving a control shaft actuator and which causes variation of a position of the rocker arm, thereby causing a lift characteristic of the intake or exhaust valve to be continuously variable;

a flange portion protruding from an outer circumferential surface of the control shaft configured to regulate movement of the control shaft in an axial direction thereof, a stopper protrusion which protrudes from the flange portion; and a cylinder head rotatably supporting the control shaft, the cylinder head including a flange bearing portion which contacts the stopper protrusion, the flange bearing portion having a groove receiving the flange portion such that the flange portion is disposed in the groove so as to regulate the movement of the control shaft in the axial direction.

2. The variable valve actuation mechanism for an internal combustion engine, according to claim 1, wherein the stopper protrusion is formed to an outer circumference of the flange portion.

3. The variable valve actuation mechanism for an internal combustion engine, according to claim 1, wherein the flange bearing portion includes a stopper protrusion receiving surface; and the stopper protrusion includes erect walls configured to abut the stopper protrusion receiving surface.

4. A variable valve actuation mechanism for an internal combustion engine, the mechanism comprising:

a drive shaft which rotates in operative association with rotation of a crankshaft, thereby to drive an intake or exhaust valve to open or close by way of a rocker arm;

a control shaft which is rotated by driving a control shaft actuator and which causes variation of a position of the rocker arm, thereby causing a lift characteristic of the intake or exhaust valve to be continuously variable;

a flange portion protruding from an outer circumferential surface of the control shaft configured to regulate movement of the control shaft in an axial direction thereof;

a stopper protrusion which protrudes from the flange portion; and a cylinder head rotatably supporting the control shaft, the cylinder head including a flange bearing portion which contacts the flange portion and the stopper protrusion, the flange bearing portion including a stopper protrusion receiving surface, the stopper protrusion including erect walls configured to abut the stopper protrusion receiving surface, the cylinder head further including a bearing body portion which rotatably supports a journal portion of the control shaft and a cap portion rotatably clamping the journal portion with the bearing body portion, with the stopper protrusion receiving surface and coupled surfaces of the bearing body portion and the cap portion being positioned on a same plane.

5. The variable valve actuation mechanism for an internal combustion engine, according to claim 4, wherein the bearing body portion and the flange bearing portion are integrally formed.

6. The variable valve actuation mechanism for an internal combustion engine, according to claim 5, further comprising a plurality of bearing body portions, each having the same configuration as the bearing body portion, provided in a direction of a cylinder array of the internal combustion engine, the control shaft actuator being provided on a first end of the control shaft, and the flange bearing portion being formed integrally with a first bearing body portion of the plurality of bearing body portions, which is nearest the first end.

* * * * *